US011679473B2

(12) United States Patent
Nguyen

(10) Patent No.: US 11,679,473 B2
(45) **Date of Patent: *Jun. 20, 2023**

(54) DRY WET BLAST MEDIA BLASTING SYSTEM

(71) Applicant: Phuong Taylor Nguyen, Richmond, TX (US)

(72) Inventor: Phuong Taylor Nguyen, Richmond, TX (US)

(73) Assignee: Axxiom Manufacturing, Inc., Fresno, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/781,889

(22) Filed: Feb. 4, 2020

(65) Prior Publication Data

US 2022/0281072 A1 Sep. 8, 2022

(51) Int. Cl.
*B24C 5/02* (2006.01)

(52) U.S. Cl.
CPC ..... *B24C 5/02* (2013.01)

(58) Field of Classification Search
CPC ..... B24C 5/02; B24C 5/04
See application file for complete search history.

(56) References Cited

U.S. PATENT DOCUMENTS 4,728,205 A * 3/1988 Hasumi ..... B41J 2/275 400/124.22
4,768,709 A * 9/1988 Yie ..... B24C 5/02 239/336
4,821,467 A * 4/1989 Woodson ..... B24C 7/0084 451/99
9,138,863 B2 * 9/2015 Schubert ..... B24C 1/045
2004/0202980 A1 * 10/2004 Policicchio ..... A61M 11/02 433/88
2009/0071303 A1 * 3/2009 Hashish ..... B24B 41/00 83/53
2009/0130959 A1 * 5/2009 Mase ..... B24C 7/00 451/38
2016/0236323 A1 * 8/2016 Mase ..... B24C 1/08
2016/0339560 A1 * 11/2016 Hashish ..... B24C 1/045
2017/0259400 A1 * 9/2017 Orlandi ..... B24C 5/02
2023/0001245 A1 * 1/2023 Altmueller ..... B05B 7/0408
2023/0035722 A1 * 2/2023 Hayes ..... C09K 3/1463

* cited by examiner

*Primary Examiner* — Omar Flores Sanchez
(74) *Attorney, Agent, or Firm* — Kearney, McWilliams & Davis, PLLC; John M. DeBoer

(57) ABSTRACT

A wet media blasting system with a water injection system that provides more uniform distribution of the water, air and media components for achieving a more efficient mixture while minimizing the amount of water required to contain and minimize or eliminate airborne particulate matter such as dust produced during the blasting operation. The system supports dry blasting, wet blasting, and water wash down modes and air drying modes. When blasting, by more thoroughly mixing the water into the abrasive/water mix, the amount of water required is reduced. The abrasive feed is placed and shaped to optimize spray coverage and minimize abrasive flow into injection space thus mitigating water nozzle clogs. The water injectors are downstream of the air/abrasive mixing station.

17 Claims, 5 Drawing Sheets

DRY WET BLAST MEDIA BLASTING SYSTEM

CROSS-REFERENCE TO RELATED APPLICATIONS

This application is a continuation-in-part of U.S. patent application Ser. No. 15/417,546, entitled: "Dry Wet Blast Media Blasting System", filed on Jan. 27, 2017, inventor: Phuong Taylor Nguyen (the '546 application). The '546 application is incorporated by reference herein and all information disclosed in that application is to be treated as if fully disclosed herein.

FIELD OF THE INVENTION

The invention is related to media blasting systems and is specifically directed to wet/dry media blasters.

DISCUSSION OF THE PRIOR ART

Traditional media blasting systems use dry blast media which is stored in a bulk tank or pot with an outlet for introducing the media into a media control valve or metering valve. The metering valve is also connected to a source of pressurized air whereby blast media is mixed into the air stream. The blast media and air stream mix are then propelled through a nozzle and directed onto a work surface. Systems of this design are well known and widely available. One such source of traditional dry media blasting systems is manufactured by Axxiom Manufacturing, Inc. of Fresno, Tex., which offers the Schmidt brand blasting equipment.

Dry media blasting systems have proven to be very effective in media blast operations and have been in operation for over 100 years. However, such systems do release the blast media or dust into the surrounding area during operation. This is not an issue in some applications but there are many circumstances where dust containment or suppression is desirable or required.

Wet media blasters have been created to minimize the generation of airborne media blasting operations. In a broad sense, there are many units that combine water and abrasive and release the flow of the pressurized combination into a stream of pressurized air through a nozzle.

In industrial applications, there are two types of wet media blasting systems. In the first, water is mixed in with the media in the media storage tank. The mixture of media and water is then released and introduced into a blast nozzle, i.e., introduced, into a pressurized air flow through a blast hose coupled to the blast module at and directed to blast release outlet 21 the second, the abrasive media and air are mixed upstream of a water injection system located upstream of the inlet port of the blast release nozzle.

Both systems are effective in reducing the presence of airborne dust during operation. The first of the systems shown and described in the '546 application is a water/abrasive/air system that departs from the prior art by placing the water inlet port downstream of the abrasive release point, enhancing the flushing function and providing a better clean water rinse. The system in the '546 application is unique in that it more evenly mixes the abrasive/air/water mixture to improve blasting results and reduce the amount of water required to achieve the correct mix. It permits use of the system in the standard three functional modes: (1) wet abrasive blasting, (2) dry abrasive blasting and (3) flowing water under pressure for cleaning the flow path of the water and abrasive or for washing the blast area. In addition, the system supports air drying by disengaging the media delivery and water delivery systems and allowing only pressurized air to flow into the water module and ultimately through a blast nozzle Known prior art system injects water into an air flow the air/abrasive mixed the water as it flows by a water delivery system upstream of the point where the air/abrasive are introduced into the mix. This system is inefficient on that it cannot minimize the use of water and achieve the appropriate mix o without wasting water. Also, such system are prone to failure when the dry abrasive clogs the water release system including at times a complete shutdown and cleaning of the water delivery system.

SUMMARY OF THE INVENTION

The subject invention is directed to an improved wet media blasting system with an unique water injection system that provides more uniform distribution of the water, air and media components for achieving better application of the mixture while minimizing the amount of water required to contain and minimizing or eliminating airborne particulate matter such as dust produced during the blasting operation. Also, by more thoroughly mixing the water into the abrasive/water mix, the amount of water required is reduced. The water pressure and air pressure are independently controlled providing maximum flexibility in the system for desired delivery of the released blast mixture.

The invention is directed a simplified operation mode permitting the four defined modes: (1) wet abrasive blasting, (2) dry abrasive blasting, (3) water flushing under pressure for cleaning the flow path of the water and abrasive or for washing the blast area, and (4) an air only mode for a drying or blowing operation with a controlled air flow pressure.

In accordance with the invention, the abrasive feed is placed and shaped to optimize spray coverage and minimize abrasive flow into injection space, thus mitigating water nozzle clogs. The abrasive flow is shaped as it is released from the metering valve to tighten the abrasive flow before it enters the blast air stream. The shaped and tightened abrasive flow is introduced at the lower portion of the blast air stream. The abrasive media is positioned to flow in optimum placement for spray wetting the abrasive as it flows into and through the nozzle. This also mitigates nozzle clogging by directing most of the abrasive flow away from the water spray nozzle port.

In the subject invention the water spray is placed downstream of the abrasive-air mixing point. By placing the water input downstream of the abrasive/air mix, the back flow of abrasive media and air is minimized. The blast air flow keeps the grit and dust away from the water injection spray nozzle, minimizing or even eliminating the tendency to clog the spray nozzle. Reshaping and lowering the abrasive entry opening into the compressed air stream directs most of the abrasive flow away from the water injection nozzles. This minimizes how much abrasive flows near the water injectors.

The spray nozzle is placed sufficiently within the spray port to further decrease the likelihood of abrasive contact with the water spray nozzle. The radial orientation of the water spray nozzle relative to the abrasive feed orientation allows optimum effectiveness for wetting the abrasive.

DETAILED DESCRIPTION OF THE ILLUSTRATED EMBODIMENTS

Figure 1:
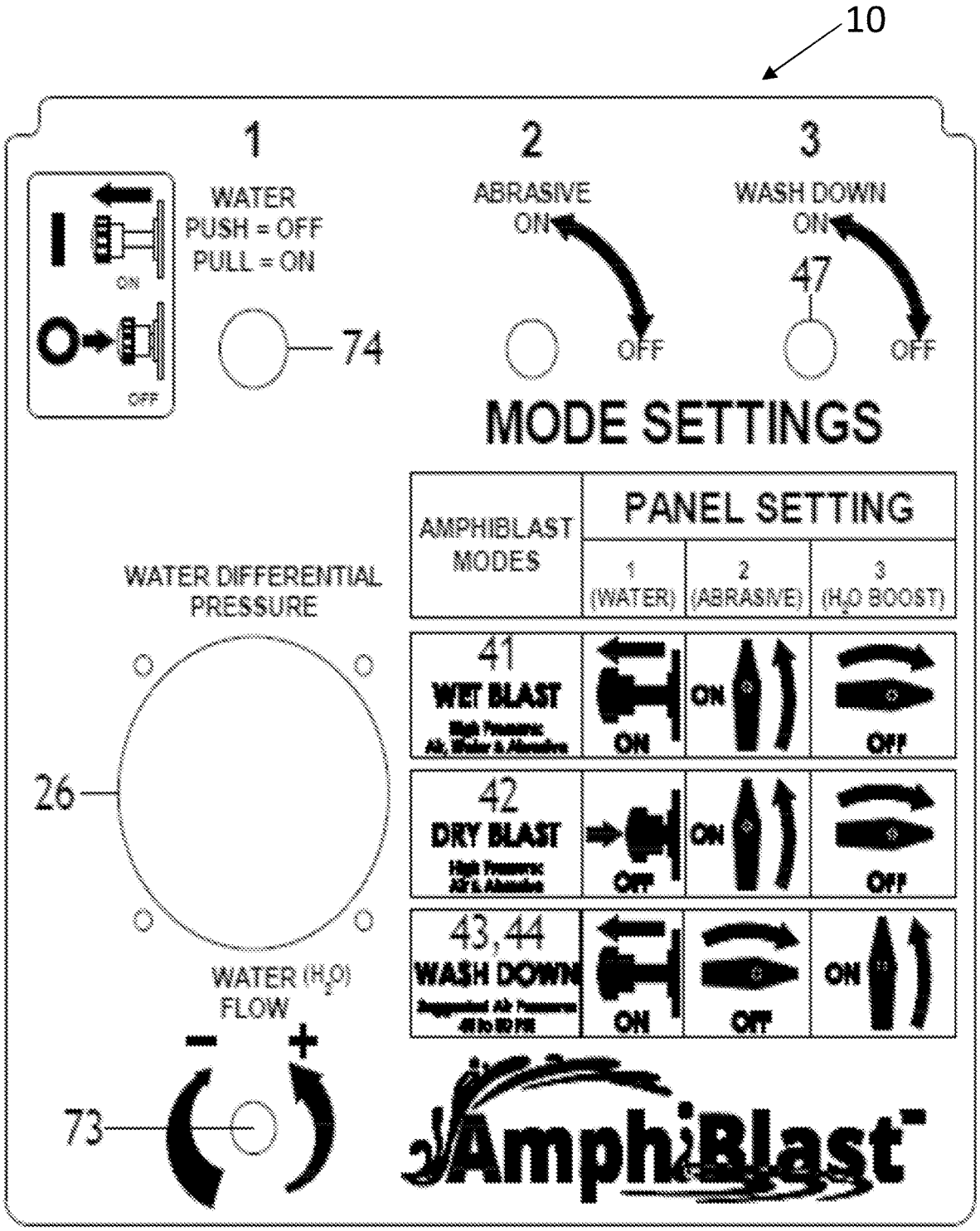
FIG. 1 is an illustration of a sample control panel which is simple to read and understand to facilitate quick, safe and simple control by an operator for operating and controlling blasting operations.

The subject invention is directed to a wet media blasting system with a unique water injection system that provides more uniform distribution of water air and abrasive for achieving better application of the mixture while minimizing the amount of water required to contain and minimize or eliminate airborne particulate such as dust produced the blasting operation.

A differential pressure gage 26 is positioned between water pressure line 28 and blast air pressure line 30 to indicate, quantify, and control water flow. A metering valve 50 is used to provide adjustable and repeatable water flow control to control water flow by varying the effective flow rate for water. The water pump 34 (FIG. 2) is set to be constant. This simplified operation is a significant advantage over prior art systems. The differential pressure gage 26 is positioned to measure the difference between the water pressure and blast air pressure, since water injection cannot be achieved unless the water pressure is greater than the blast air pressure. Typically, the spray nozzle 56 (best shown in FIGS. 2 and 4) is a fixed orifice, and water flow rate is proportional to how much the water pressure is greater than the blast air pressure.

The differential pressure gage reading provides the operator with a visual indication of water volume flow rate. In addition, a water flow adjustment valve 31 is provided for permitting the operator to adjust the water pressure. The pressure differential indicator 26 and the water flow adjustment valve 29, in combination, provide the operator with the means to consistently, precisely, and repeatedly control the water flow rate. Manually variable water flow is important because each operator will adjust the water flow according to the abrasive type, abrasive size, abrasive flow rate, dust content, blast nozzle size, blast pressure, and other blast equipment operating parameters.

An additional feature of the invention is the inclusion of a wash down mode. After wet blasting, the surface is usually left with residual abrasive and fine dust. This requires a rinse to wash the abrasive off the surface. The water flow rate for washdown is significantly higher than the water flow rate during blasting, which is usually for dust control. It may be desirable to include a second injector 57 to be employed only during wash down for increasing the pressure and water flow when more pressure and water volume is required than can be delivered by the single spray injector 56.

Another additional feature is a blow off function using compressed air to blow dry and ready the blasted surface for finishing, such as painting. This feature basically allows two settings of air pressure. One is for blasting which is generally greater than 80 psig. The washdown and blow off could be the same as blast air pressure or lower pressures such as 40 psig. The operator can manually adjust the desired air pressure using the air pressure regulator.

The system of the subject invention can be configured as a portable unit or as a stationary system (with a large blast pot for storing and delivering abrasive media to the system through a metering valve 50, as shown in the drawings). This maximizes adaptability to various operations. The portable unit is equipped with handles and wheels and can be rolled to locations where blast jobs are remotely performed. The stationary unit is designed to be installed in a permanent location and may be installed below an abrasive hopper 5 (or blast pot), removing the need to have an abrasive hopper 5 mounted on the unit and also increasing capacity. Single or multiple spray nozzles may be utilized as determined by the compressed air requirements for each application. The spray nozzle size and blast pressure determine the compressed air requirements. Air compressor size is also determined by each application. Single outlet and multiple outlet units are supported.

The system is adapted to be connected to a blast hose (not shown) which is connected to the blast nozzle outlet 20 for delivering the wet abrasive mix to a workstation, i.e., a surface to be treated. A source of abrasive media is provided in storage unit 5 to be fed by gravity into a mixing chamber 23 in the metering valve 50. The pressurized air flows into and through the metering chamber picking up the released abrasive, exiting as an air/abrasive mix. The mix then flows into and through the water injection module 24 downstream of the mixing metering valve 50, where a source of pressurized water is injected into the air/media mix by the injector 56 (and optionally injector 57) upstream of the blast nozzle outlet 20, but downstream of the mixing metering valve.

The system supports disabling the source of abrasive media such that the pressurized water and air are delivered to the nozzle as pressurized water source for providing a water washdown mode for the system. Also, the system supports a mode permitting the source of water and the source of abrasive media to be disabled, i.e., OFF, permitting the pressurized air flow to operate as a drying system or other blower functions. The water control valve 70 controls flow through the network and includes at least one differential pressure gage 26 positioned between and in communication with the water pressure source and the air pressure source for monitoring and controlling water flow, and for monitoring the pressure differential between water pressure and air pressure to assure that the water pressure is greater than the air pressure.

Figure 2:
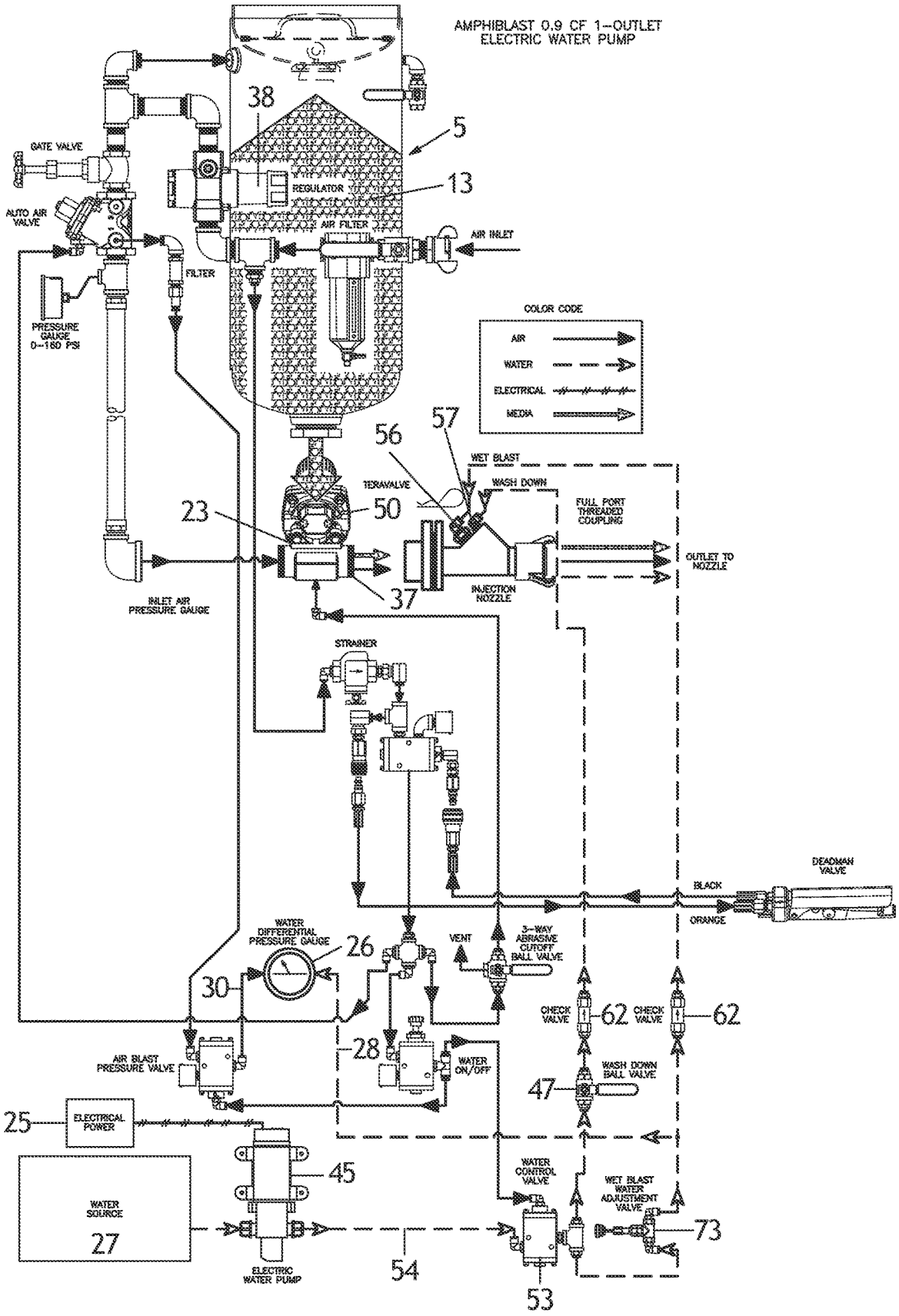
FIG. 2 is a diagrammatic view of a stationary abrasive blast system incorporating the wet/dry unit of the subject invention with a constant speed electric power system.
Figure 3:
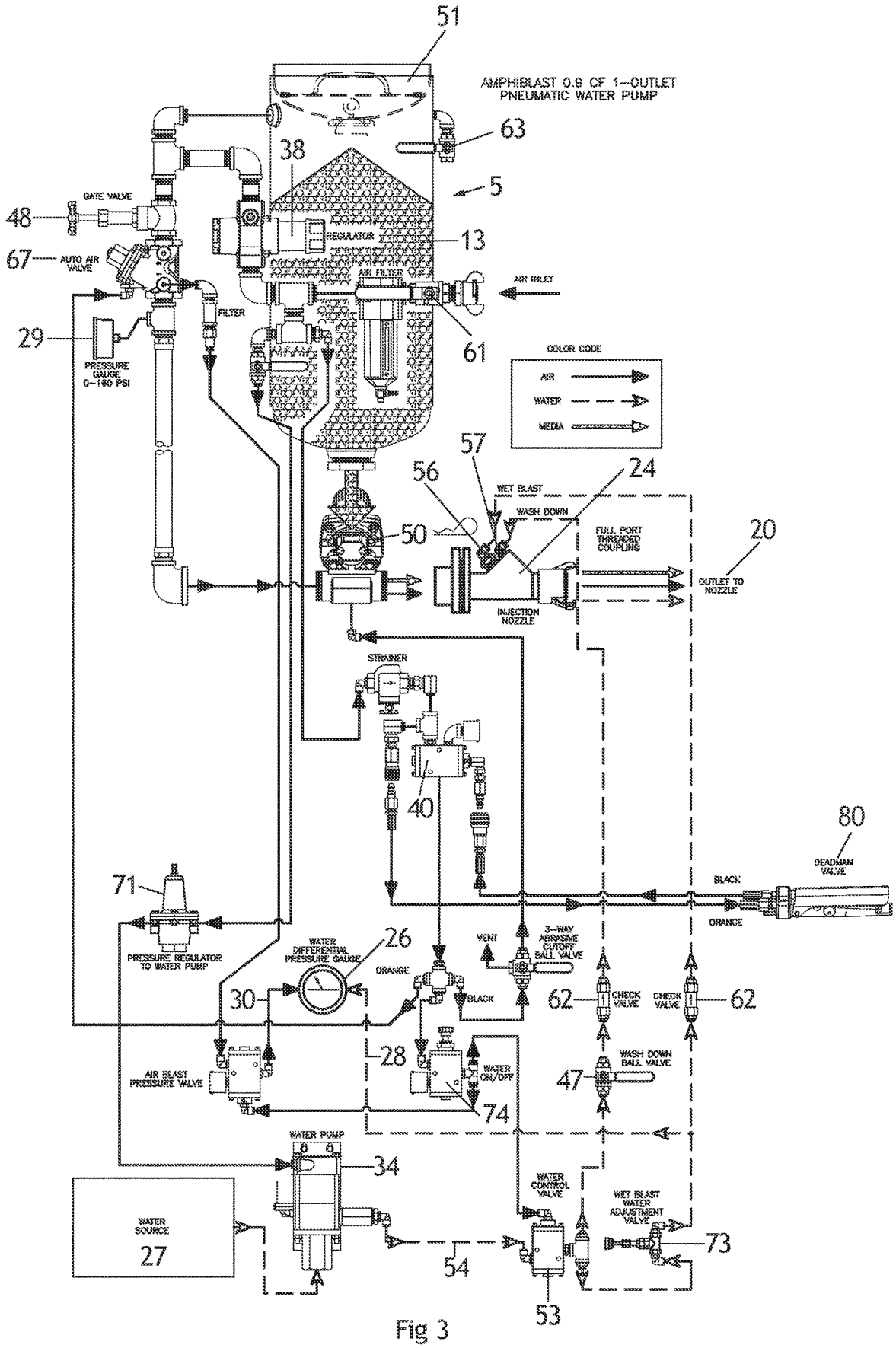
FIG. 3 is a diagrammatic view of a stationary abrasive blast system incorporating the wet/dry unit of the subject invention with a set pneumatic power water pump system.

Operational circuits for the system are shown in FIGS. 2 and 3. Although blast control can be hydraulic, FIG. 2, or electric, FIG. 3 (shown with pneumatic blast controls). The electric and pneumatic designation of FIGS. 2 and 3, respectively are useful in specifying what is the optimum type of water pump for each specific configuration.

Turning specifically to FIG. 2, the water source 27 is connected to an electrically powered hydraulic water pump 45, which operates at constant speed. In contrast, in FIG. 3 the water source 27 is connected to a pneumatic driven water pump 34 which is driven by the set air pressure from the output of the pressure regulator to water pump 34. In either case these power sub-circuits stabilize the water source for the respective circuits. The remainder of the circuitry is identical and common reference numerals are used in both circuits.

In the alternative embodiment of FIG. 3, the storage tank or other storage system 5 contains a supply of abrasive media 13 which is introduced into the mixing chamber 23 of the metering valve 50. The media/air mix created in the metering valve mixing chamber 23 is directed into the water injection module 24 at port 27. Pressurized water is released through the water injection valve 53 and to the water injection module 24 downstream of the metering valve 50. The spraying water injectors 56,57 are each a fixed orifice water nozzle.

The air/abrasive mix of media 13 is gravity fed from the abrasive storage container 5 and downstream into the injection chamber 91 and upstream of the water injection module 24. This design shares the abrasive flow restrictor 12 (FIG. 5) which mixes the abrasive into the blast air stream in order to direct abrasive flow away from the water injection nozzles 56, 57.

Pressure of the water/air/media flow depends upon the air pressure at the dam and/or or gate restrictor 12. The metering valve 50 directs the flow to a lower portion of the conduit, tightening the flow of abrasive media along specified portion of the of water injection module 24. The inner walls of the conduit 91 define the water injection module 24 which includes restriction on media flow through a controlled path, with restrictions and management of the path of the mix as it passes through the water injection module 24.

As shown, the air/abrasive mix enters the water injection module as the mix flows from the metering valve 50 to conduit port 97. The flow is restricted by the changes in internal diameter of the spraying chamber. A restrictor 12 is provided at the port 99 to limit the amount of media 13 that is released from the storage tank 5 and into the mixing chamber of metering valve 50. The flow diameter of the conduit is largest at the actual injection point 98 and the media tend to drop into a dip in the conduit floor at this point, which, along with the water spray from the nozzle(s), pushes the media up and out through the narrow opening in the blast flow port 100 of the module 24 and into the blast nozzle module 101.

The wet dry blast system of the subject invention can be configured in any one of four separate modes as controlled by the control panel 10. All of the modes require pressurized air. Pressurized water is used in wet blast and washdown modes. The operating panel 10 (FIG. 1) simplifies the understanding of the system. In addition to air, the mode settings are as follows:

a. WET BLAST 41: the media delivery system and the water flow are both activated to provide a wet blast mixture by switching "Water" and "Abrasive" "ON" and "Wash Down" OFF;
b. DRY BLAST 42: wherein only the "Abrasive" is "ON", "Water" OFF and "Wash Down" is OFF to provide a dry abrasive delivery for dry blasting;
c. WASH DOWN 43: the "WATER" and "Wash Down" are ON. Abrasive is OFF to provide a water only wash down, only the water flow is activated to provide a higher volume flow water rinse, during this mode the auxiliary injector 57 may be activated. This is done by activating the wash down ball valve 47.
d. LOW PRESSURE WASH 44: water flows through system with reduced air pressure. The settings are the same as the third mode 43 except the operator will manually adjust the blast air regulator 27 to lower the blast air pressure. This mode produces even greater water flow and the lower blast air pressure generates less blast nozzle thrust and blast nozzle noise.
e. AIR DRYER: In addition a fifth mode can be created by turning the water and abrasive OFF and letting the system operate as an air dryer by allowing air only to flow through the system under a desired air pressure. This can be done at high or low air pressure.

The water pressure differential gage 26 (see also FIGS. 2 and 3) is mounted on the control panel 10 to visually indicate the difference between the air pressure and the water pressure in the system. The water control knob 73 may be adjusted to provide the correct balance which changes with the abrasive used, and the level of pressure on the pressurized air and pressurized water, see FIG. 1. The water pressure should always be higher than air pressure to guard against any backflow of media during operation. This is assured by the check valves 42 and a visual setting is provided at differential pressure gage 26.

A branch conduit 34A of water the delivery conduit 34 provides the differential gage 26 with a continual reading of the water pressure in the system.

Operational circuits for the system are shown in FIGS. 2 and 3. FIG. 2 is an electric powered water pump system and FIG. 3 utilizes a pneumatic powered water pump 34. In FIG. 2, the water source 27 is connected to a water pump 45, which is powered by electrical power.

In contrast, in FIG. 3 the water source 27 is connected to a pneumatic water pump 34, which is driven by pneumatic pressure from a pressure regulator 72. In either case these sub-circuits stabilize the water source for their respective circuits.

Output from either water pump 34 (electric) or 45 (pneumatic) is delivered to the water flow adjustment valve 40. The water pump 34 (or 45 in the electric diagram, FIG. 3) delivers pressurized water to the water control valve 53, which varies the flow area to control water flow rate.

The system includes conduit segment 24 having one end coupled to an air injector system and the other end coupled to a blast nozzle. The air injector system is adapted for supplying pressurized air flow flowing from one end, through the metering valve 50 and toward and out the blast nozzle outlet 20 at the other end. The media delivery system is configured to introduce media into the conduit and into the air flowing through the metering valve 50 with the water delivery system adapted for introducing water into the air/media mix downstream of the media delivery system for generating a wet media mix for release at the blast nozzle for providing a wet blasting mix.

Typically, and as described below, the metering valve 50 is part of the media delivery system and includes a restrictor 12 in the metering valve 22 for directing the injected media to a predefined area 59 (See FIGS. 2 and 574) and 4 of the conduit to provide more clear space for the injected water permitting the water to flow into and more fully saturate the released air/abrasive mix.

FIG. 2 is an illustration of the circuit and system configured for an electric pump 45 and a water source 27. The system of FIG. 2 relies on an available configuration. The electric power system of FIG. 3 comprises an electric power source 25, water supply 27 and pump 45.

The wet/dry system of the invention is adapted for providing a mixture of wet abrasive and compressed air to a blast nozzle connected at outlet 20. The abrasive blast stream through the blast nozzle is used for removing rust, paint, or other unwanted surface defects. After abrasive blasting, the same system is used to wash off and dry the treated surface before it is ready for new paint or coating. Pressurized air is provided by a typical air compressor (not shown) connected to the auto air valve 47, a gate valve 45, and a water source 27. The blast abrasive is loaded into the abrasive blaster storage tank for example the blast pot 5 which is loaded through dan through an abrasive inlet 51 at the top of the blast pot. The abrasive can be bag loaded, or loaded from a larger storage hopper.

To begin blasting, the abrasive inlet 51 is closed and the blast pot 5 is filled with compressed air from a standard air compressor (not shown). The air pressure in the abrasive blast pot 5 is raised until it is equal to the air pressure in the blast hose where it connects to the metering valve 50. This allows the blast abrasive to flow downward by gravity. The abrasive flow is controlled by the single metering valve 50, for example, the TeraValve (offered by Axxiom Mfg., Fresno, Tex.) at the bottom of the blast pot 5. From the metering valve 50 the blast abrasive flows into the blast air stream and the air/abrasive mix flow into the water injection module 24 where it is injected with water downstream of the metering valve 50. In order for the system of operate properly, the water pressure must be higher than the air pressure to assure that the air and abrasive mix cannot back flow. The mixture of wet abrasive and air then flows through the blast nozzle module 24, and through a blast hose (not shown), through blast nozzle and onto a work surface.

Blasting starts when a deadman lever is engaged. In the embodiments of FIGS. 2 and 3, the deadman lever is connected to the system at the deadman valve 80 and operates in the well-known manner. Specifically, when the deadman lever is engaged the system is powered up, and when the lever is released the system shuts down. The deadman valve 80 is connected directly to the main water control 40 and this controls the whole system. If the main water control is not open the system cannot operate. In the present embodiment blasting starts when the pump power source is turned on and the deadman lever or switch is engaged, which will electrically or pneumatically open the main water control valve.

Blasting starts when the deadman switch is engaged and the pump power source is turned on, which will electrically or pneumatically open the control valve 40. When the main control valve 40 is open, an air signal simultaneously opens the automatic air valve 47. Compressed air will pressurize the blast hose when the automatic air valve 47 is opened. At the same time, the metering valve 50 and water control valve 53 will open allowing abrasive to fall through and water to be injected (see injectors 56, 57) into the blast air stream. Note that injector 56 is used in all modes that require water flow. Injector 56, if used, is optional and is only opened when the water flow needs to be of greater pressure and flow for the specific wash down application. The water flow is increased or decreased by turning the knob 73 at the water control section of the control panel 10. Blast air pressure can be adjusted by dialing the air pressure regulator 49.

Blasting stops when the deadman switch is disengaged. This shuts off air to the signal port of the control valve 40.

The abrasive blaster pot 5 is depressurized by closing a typical air inlet ball valve 61 (shown right of "AIR FILTER") and then opening a typical blowdown ball valve 53, connected to top right of abrasive blaster pot 5 to completely vent the compressed air.

In order to blast objects that are fragile it is necessary to reduce the blast air pressure. The blast pressure regulator 27 is used to adjust the blast pressure while in "BLAST MODE". The air/water differential blast pressure is shown by the differential pressure gage 26 and can be adjusted while blasting. To adjust the blast pressure, the control knob 73 (FIG. 1) is pulled out to unlock it. The knob is turned clockwise to increase pressure and counterclockwise to decrease pressure. When the desired pressure is reached, the knob can be pushed in to lock it and prevent inadvertent adjustments.

The wash down mode is controlled by differential pressure. Adjustment is generally made while blasting so the effects are visible. To adjust the wash down pressure, the control knob 73 pulled out to unlock the system components. When the desired pressure is reached as indicated at differential gage 26, the knob 73 can be pushed in to lock it and prevent accidental changes.

The inlet pressure gage 29 shows the air pressure supplied by the air compressor. This gage makes it possible to easily troubleshoot an insufficient supply of pressurized air. If the pressure on the inlet pressure gage drops while blasting, then the air supply is insufficient for the nozzle size and blast pressure combination being used. This is especially critical on two outlet units. Fluctuations in the blast pressure will make it impossible to maintain consistent water differential pressure. There are three ways to correct the problem, 1) change to a larger air compressor, 2) change to a smaller nozzle or 3) reduce the blast pressure until no pressure drop is observed on the inlet pressure gage 29.

The electric version of FIG. 2, is as described above.

In the pneumatic version of FIG. 3, the water pump 34 is powered by compressed air to create a pressurized water source that is injected into the blast stream as it passes through the water injection module 24. The water pressure is controlled by a water pump pressure regulator 71. The water pump pressure regulator allows adjustments of the water pressure in relationship to the blast air pressure, using the differential gage 26. In operation the water pressure needs to be higher than the blast air pressure. The difference in pressure can be seen on the water differential pressure gage. To adjust the water differential pressure, turn the knob 73 (FIG. 1) clockwise to increase water pressure and counterclockwise to decrease water pressure.

In practice, it is recommended to start at five psi of differential and then fine-tune to achieve the desired results. This is a matter of choice depending on application, operator preference and other local factors, as will be well understood by those skilled in the art.

The water on/off button controls valve 40 is used to change between wet blast and dry blast. Pull the button out ("ON" position) for wet blast and push the button in ("OFF position) for dry blast. When the water on/off palm button control valve is in the "OFF" position, it stops the air signal to the water shut-off valve preventing the water from turning on. The water control valve 53 is a normally closed valve that opens to inject water into the blast stream. The water control valve opens when it receives air to its signal port. This happens when the deadman lever is engaged, which opens the blast control valve sending an air signal to the water shut-off valve. When the deadman lever disengaged, the air signal from the blast control valve vents and the water shut-off valve closes to stop the flow of water.

The water injection module 24 (FIG. 2) is where water is introduced into the blast stream. The injection module holds the spray nozzles 56 (and optionally 57) in the optimum positions to wet the abrasive in the blast stream as it exits metering valve 50 flows into the water injection module 24. When utilized in a multiple outlet mode, each blast outlet of dual outlet blast vessels operates as detailed for a single mode operation.

Figure 4:
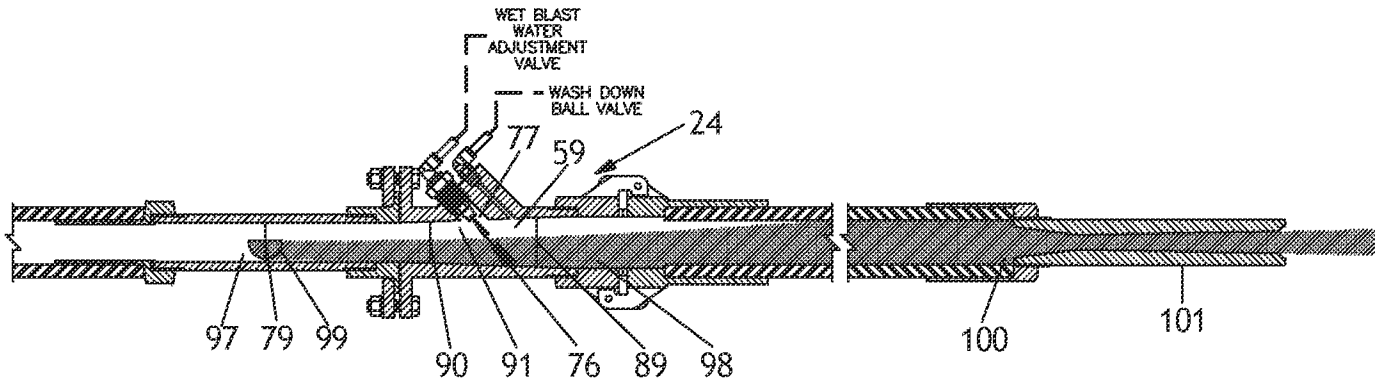
FIG. 4 is a longitudinal cross-section the water injection module used in connection with the blast nozzle downstream of the water injection module downstream of air and media mixing point.
Figure 5:
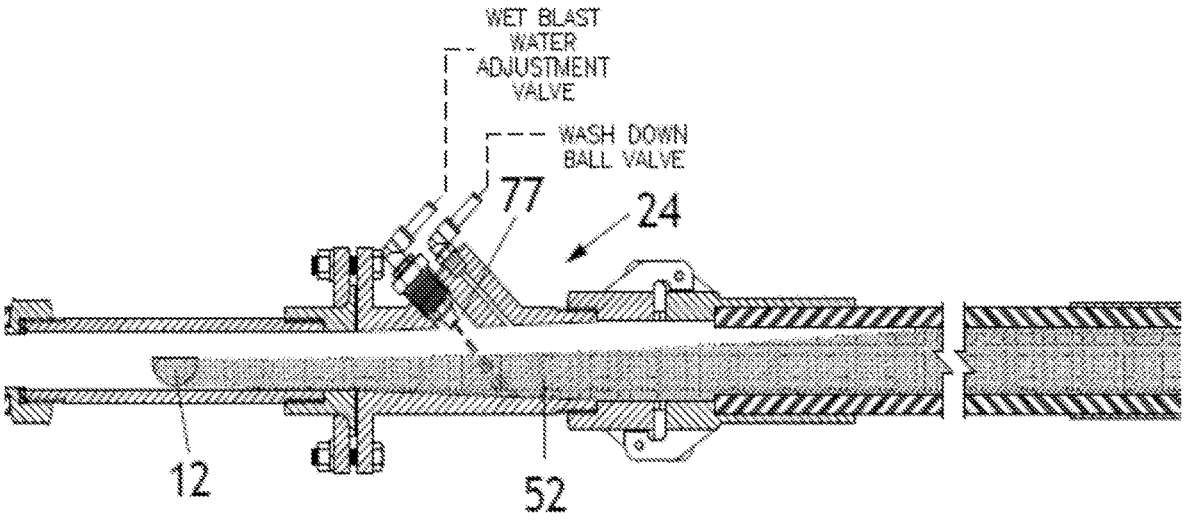
FIG. 5 is an enlarged longitudinal cross-section looking in the same direction as the cross-section shown in detail the water injection module shown FIG. 4, and illustrates the connection points where the water module is connected to the upstream mixing module and to the downstream blast module.

As shown in FIGS. 4 and 5, the water injection system module 24 is unique and novel in that instead of providing uniform media flow past the injector, the media flow is partially deflected away from the water outlet, permitting the water to flow into and more fully saturate the release nozzle flow channel. This promotes more uniform mixing of the media and water and has the added advantage of creating a space between the water injector nozzle 56 and 57 and the dry media, reducing the tendency to clog the nozzle, particularly at low pressure operation when the media can back flow toward the water injectors 56 and/or 57. Specifically, a media release port in nozzle 56 is provided downstream of the metering valve 50 and above the main air stream for directing the media stream away from the water injector nozzles. This keeps the nozzles 56,57 from being clogged and provides more clear pace in the injector module for better distribution of the water.

The water spray chamber 77 (see FIGS. 2 and 4) in the water module 24 for preventing abrasives within the flow stream from contacting the spray nozzles 56 and 57. The tapered or stepped ID feature are for preventing gravity backflow from accumulation of residual water in the spray area or blast hose. The taper internal diameter 91 and the step-down internal diameter 84 are both placed upstream of the water injection point 76 and downstream of the abrasive feed port 78. Specifically, the ID 79 of the blast air port where the abrasive is fed is smaller than the ID of the blast air port 89 where the water is injected. The enlarged ID is then maintained downstream through the blast hose (not shown). This prevents residual water from flowing upstream to where the abrasive is introduced into the blast air stream which would eventually wet and stop the abrasive flow altogether.

The differential pressure gage 26 is positioned between water pressure and blast air pressure to visually indicate, quantify, and control water injection flow rate. The ability to have consistent, adjustable, and repeatable water flow control with a simple operation is a significant advantage over prior art wet abrasive airblast systems. In the exemplary embodiment, the differential pressure indicator 26 is positioned to measure the difference between the water pressure and blast air pressure to confirm that the water pressure is greater than the air pressure.

Typically, each spray nozzle 56 and 57 have a fixed orifice, and the water flow rate is proportional to how much the water pressure is greater than the blast air pressure. This differential pressure gage reading provides the operator with a visual indication of volume flow rate. In addition, a water flow adjustment valve 53 is provided for permitting the operator to adjust the water flow area during blasting. The pressure differential gage 26 and the water adjustment valve 53, in combination, provide the operator with the means to consistently and repeatedly control the water flow rate. Manually variable water flow is an important benefit because each operator will adjust the water flow according to the abrasive type, abrasive size, abrasive flow rate, dust content, blast pressure, and surface to be blasted.

While certain features and embodiments have been explained in detail herein, it should be understood that the invention encompasses all modifications and enhancements in accordance with the following claims.

What is claimed is:

1. An abrasive media blast system of the type including a source of pressurized air, abrasive media and water in a wet abrasive mixture which can be released through a blast nozzle, the system comprising:

a. A compressor for generating a stream of pressurized air;

b. A source of abrasive adapted to be released into the pressurized air for generating an air/abrasive stream;

c. An injector downstream;

d. A source of water under pressure introduced into the injector and released from the injector into the air/abrasive mixture for creating an abrasive/water stream; and e. A blast nozzle in communication with the abrasive/water stream for receiving the abrasive/water stream and delivering it to a work surface, wherein in during operation the system is operable as follows:

a. a first mode wherein the media delivery system, air flow and the water flow are both activated to provide a wet abrasive mixture for wet blasting;

b. a second mode wherein only the media delivery system and air flow are activated to provide a dry abrasive delivery for dry blasting;

c. a third mode wherein only the air flow is activated to provide a drying system;

d. a fourth mode wherein only the water flow is activated to provide a water rinse.

2. The blast system of claim 1, further including a valve system for selectively disabling the source of water such that the mixture of pressurized air and abrasive media is delivered to the nozzle in a dry mix for dry blasting the work surface.

3. The blast system of claim 1, including a valve system for selectively disabling the source of abrasive media such that the pressurized water and air is delivered to the nozzle as pressurized water source for providing a water washdown directed to the work surface.

4. The blast system of claim 1, further including a differential pressure gage positioned between and in communication with the water pressure source and the air pressure source for monitoring and controlling water flow, for monitoring the water pressure relative to the air pressure.

5. The blast system of claim 4, wherein the differential pressure gage includes a visual indicator of the water flow rate.

6. The blast system of claim 4, wherein the differential pressure gage provides a visual indicator of the differential between the air pressure and the water pressure.

7. The blast system of claim 4, wherein the differential pressure gage assures that the water pressure is greater than the air pressure, wherein an abrasive media is introduced into the blast hose and into the flow of pressurized air downstream of the source of pressurized air and upstream of the source of water, the system comprising:

a. a gate restrictor for directing and tightening the flow of abrasive media along a lower portion of the flow conduit;

b. a water source downstream of the restrictor for providing a water shower for wetting the abrasive media as it flows through the flow conduit.

8. The wet dry blast system of claim 1, wherein water particles combine with dust particles of the abrasive in order to increase an overall mass of combined particles such that the combined particle is no longer light enough to stay airborne.

9. The blast system of claim 8, wherein the first mode defines an abrasive/water mix wherein air flow, media release and water flow are activated for wet blasting.

10. The blast system of claim 8, wherein the fourth mode defines a water rinsing system with water being dispersed from the nozzle at a lower controlled pressure mode, wherein only the water flow is activated to provide a water rinse.

11. A water injection system for a blast system, comprising:

an elongated conduit having one end coupled to an air injector system and the other end coupled to a blast nozzle;

the air injector system adapted for supplying pressurized air flow flowing from said one end toward and out the nozzle at said other end;

a media delivery system for introducing media into the conduit and into the air flow downstream of said one end; and a water delivery system for introducing water into the air/media mix downstream of the media delivery system for generating a wet media mix for release at the nozzle for providing a wet blasting mix, wherein the media delivery system includes a restrictor for directing the injected media to a predefined area of the conduit to provide more clear space for the injected water.

12. The blast system of claim 11, wherein there is further comprised of a water inlet chamber which is positioned outside of the conduit and in communication therewith, water release nozzle in the chamber, whereby the water release nozzle is spaced from and does not come in direct contact with the interior of the conduit.

13. The blast system of claim 12, wherein the water inlet chamber has an outlet orifice on an oblique angle relative to the conduit with the water release end of the inlet chamber skewed toward the downstream flow of the conduit, minimizing backflow from the conduit flow path into the water release system.

14. The blast system of claim 11, wherein the interior cross-sectional area of the conduit has a larger interior diameter at the nozzle end and a smaller interior diameter at the air flow injection end, reducing the likelihood of gravity backflow.

15. The blast system of claim 14, wherein the different interior diameters are generated by step components.

16. The blast system of claim 14, wherein the different interior diameters are created by a gradual slope on the interior wall of the conduit.

17. The blast system of claim 11, wherein the interior diameter of the conduit at the release point of the water delivery system is larger than the interior diameter of the conduit at the air injector end to further reduce the likelihood of back flow of media into the water delivery system.

* * * * *